US005897256A

United States Patent [19]

Kameyama

[11] Patent Number: 5,897,256

[45] Date of Patent: Apr. 27, 1999

[54] INK RIBBON CARTRIDGE RETENTION DEVICE FOR A RECORDING APPARATUS

[75] Inventor: Yoshikatsu Kameyama, Hashima-gun, Japan

[73] Assignee: Brother Kogyo Kabushiki Kaisha, Nagoya, Japan

[21] Appl. No.: 08/991,342

[22] Filed: Dec. 16, 1997

[30] Foreign Application Priority Data

Jan. 6, 1997 [JP] Japan ..... 9-000218

[51] Int. Cl.[6] ..... B41J 35/28

[52] U.S. Cl. ..... 400/208; 400/246; 347/214

[58] Field of Search ..... 400/207, 208, 400/208.1, 246; 347/214

[56] References Cited

U.S. PATENT DOCUMENTS

| | | | |
|---|---|---|---|
| D. 383,743 | 9/1997 | Suwa et al. . | |
| 4,160,605 | 7/1979 | Neubaum | 400/208 |
| 4,917,513 | 4/1990 | Takanashi et al. | 400/208 |
| 4,924,242 | 5/1990 | Fukawa | 400/246 |
| 4,978,240 | 12/1990 | Katsuno | 400/246 |
| 5,100,250 | 3/1992 | Suzuki et al. | 400/208 |
| 5,110,228 | 5/1992 | Yokomizo . | |
| 5,236,267 | 8/1993 | Masumura et al. | 400/208 |
| 5,399,035 | 3/1995 | Nakae . | |
| 5,451,996 | 9/1995 | Awai et al. | 400/208 |
| 5,480,242 | 1/1996 | Gunderson | 400/208 |
| 5,516,219 | 5/1996 | Leonard et al. | 400/246 |

FOREIGN PATENT DOCUMENTS

| | | | |
|---|---|---|---|
| 0 435 108 A2 | 7/1991 | European Pat. Off. . | |
| 61-51380 | 3/1986 | Japan | 400/246 |
| A-61-54969 | 3/1986 | Japan . | |
| A-61-222772 | 10/1986 | Japan . | |
| A-3-169578 | 7/1991 | Japan . | |
| 5116410 | 5/1993 | Japan | 400/208 |
| A-5-270089 | 10/1993 | Japan . | |
| WO 95/19889 | 7/1995 | WIPO . | |

OTHER PUBLICATIONS

Patent Abstracts of Japan, Publication No. 06246995, Sep. 6, 1994.

Patent Abstracts of Japan, Publication No. 09136464, May 27, 1997.

Patent Abstracts of Japan, Publication No. 60245574, Dec. 5, 1985.

Patent Abstracts of Japan, Publication No. 61213180, Sep. 22, 1986.

A Brother PC–101 first sold Jul. 1995 (Photos Attached).

*Primary Examiner*—Edgar Burr
*Assistant Examiner*—Amanda B. Sandusky
*Attorney, Agent, or Firm*—Oliff & Berridge, PLC.

[57] ABSTRACT

The invention provides a recording apparatus capable of preventing deterioration of printing quality likely to be caused by ink ribbon creases. The recording apparatus uses a replaceable ink ribbon cartridge which has an ink ribbon wound on a take-up spindle and a feed spindle. A take-up spindle support section rotatably supports the take-up spindle when the ink ribbon cartridge is mounted in a specific position. The recording apparatus is further provided with a displaceable retaining member displaceable between a first position, for holding the take-up spindle between the take-up spindle support section and the retaining member to restrict the displacement of the take-up spindle, and a second position, for permitting movement of the take-up spindle into the take-up spindle support section.

17 Claims, 12 Drawing Sheets

INK RIBBON CARTRIDGE RETENTION DEVICE FOR A RECORDING APPARATUS

BACKGROUND OF THE INVENTION

1. Field of Invention

The invention relates to a recording apparatus for printing by the use of an ink ribbon cartridge mounted with a replaceable wide ink ribbon.

2. Description of Related Art

When a thermal printer is used to print on ordinary paper, generally a ribbon cartridge is used because of easy handling. When the thermal printer is a line printer, it is necessary to use a wide ink ribbon.

The wide ink ribbon, when used, is likely to crease. A crease in the ink ribbon adversely affects printing quality, and therefore it is desirable to prevent crease occurrence. To ensure this, it becomes necessary to provide a proper amount of tension to the ink ribbon between the press roller for pressing the recording paper and the ink ribbon to the recording surface of the print head and the take-up spindle of the ink ribbon. In earlier embodiments during development if such a tension was applied, however, the take-up spindle rose, resulting in a creased ink ribbon.

That is, the take-up spindle of the ink ribbon was provided on the ribbon cartridge side, and was supported by the take-up spindle support section on the casing body side when the ink ribbon cartridge was mounted in a specific position in the casing body. In this case, however, it was necessary to allow the take-up spindle to advance into the take-up spindle support section on the casing body side. Such a structure can not preclude the rise of the take-up spindle. The rise of the take-up spindle, even if as little as about 0.2 mm, resulted in serious damage to the printing quality, particularly when the take-up spindle is made of paper and a synthetic resin to reduce manufacturing costs, the take-up spindle, being light in weight, presents a serious problem.

However, in this earlier laboratory prototype recording apparatus, no special measures were adopted to prevent the rise of the take-up spindle and a sufficient tension to restrain the rise of the take-up spindle was applied to the ink ribbon. The structure can not fully restrain the occurrence of ink ribbon crease, resulting in a deteriorated printing quality.

SUMMARY OF THE INVENTION

In view of the above-described problem, it is an object of the invention to provide a recording apparatus capable of restraining creasing of the ink ribbon in order to prevent a deterioration in printing quality.

To accomplish the object stated above, the recording apparatus comprises a replaceable ink ribbon cartridge which has an ink ribbon wound on a take-up spindle and a feed spindle, and a take-up spindle support section for rotatably supporting the take-up spindle when the ink ribbon cartridge is mounted in a specific position. The recording apparatus is provided with a displaceable retaining member between a first position for holding the take-up spindle between the take-up spindle support section and the retaining member to restrict the displacement of the take-up spindle and a second position for permitting advance of the take-up spindle to the take-up spindle support section.

According to the recording apparatus, as there is provided a displaceable retaining member between a first position for holding the take-up spindle between the take-up spindle support section and the retaining member to restrict the displacement of the take-up spindle and a second position for permitting advance of the take-up spindle to the take-up spindle support section, the take-up spindle will not rise if a sufficient tension is applied to prevent occurrence of creases in the ink ribbon, and consequently it is possible to effectively prevent the deterioration of printing quality likely to be caused by the creasing of the ink ribbon.

In the recording apparatus of the invention the take-up spindle has a gear formed on one end in the direction of the spindle axis; and the retaining member, when in the first position, restricts the displacement of the other end section in the direction of the axis of the take-up spindle.

The recording apparatus has the following advantage in that the rise of the take-up spindle can be effectively restricted simply by providing a retaining member for restraining the displacement of the other end in the axial direction of the take-up spindle. That is, because the take-up spindle can be prevented to some extent from rising at one end in the axial direction by gear engagement for transmitting the rotation to the take-up spindle, restricting the displacement of the other end in the axial direction suffices.

Furthermore, where the take-up spindle comprises a spool wound with the ink ribbon and two spindles which fit in both ends of the spool; the gear is formed on one of the two spindles; and the retaining member restricts the displacement of the other spindle of the two spindles when in the first position.

Such a recording apparatus has an advantage in that the take-up spindle is produced by fitting a spindle in either end of the spool, and the spindle is removed from the spool when a used ink ribbon is replaced, making it unnecessary to replace the spindle. The recording apparatus, therefore, is economical.

In the recording apparatus of the invention, where a casing for housing the ink ribbon cartridge has a casing body in which the ink ribbon cartridge is mounted, and a cover which is openably mounted to the casing body and permits advance of the ink ribbon cartridge into the casing body when the cover is in an opened position; the retaining member is attached on a lock lever for locking the cover to the casing body when the cover is in a closed position.

Such a recording apparatus has the advantage that, because the retaining member is attached on the lock lever, it is unnecessary to particularly set a support mechanism for supporting the retaining member and a positioning mechanism for positioning the support mechanism, thus effectively restraining a rise in manufacturing costs and an increase in size. That is, the lock lever is preset accurately to reliably lock the cover, and therefore the positional accuracy of the retaining member can be obtained by accurately attaching the retaining member to the lock lever.

Furthermore, the recording apparatus of the invention may have the lock lever rotatably attached to the cover and an opposite surface of the retaining member, in relation to the take-up spindle, that intersects at right angles a line segment connecting the center of rotation of the lock lever with the center of rotation of the take-up spindle.

In such a recording apparatus, the lock lever is attached to the cover. Therefore when the cover is open during the replacement of the ink ribbon cartridge, the retaining member is positioned apart from the take-up spindle. The retaining member, therefore, will not disturb the replacement of the ribbon cartridge. Moreover, since an opposite surface of the retaining member in relation to the take-up spindle intersects at right angles a line segment connecting the center of rotation of the lock lever with the center of rotation of the take-up spindle, the lock lever can be effectively restrained from turning in the unlocking direction with the ink ribbon tension to raise the take-up spindle.

That is, the ink ribbon tension which raises the take-up spindle prevents the lock lever from turning in the unlocking direction; and therefore, if a spring force acting on the lock lever in the locking direction is increased, the force for locking and unlocking the lock lever when the cover is opened and closed becomes unnecessarily too great to handle. However, if the opposite surface of the retaining member in relation to the take-up spindle intersects at right angles a line segment connecting the center of rotation of the lock lever with the center of rotation of the take-up spindle, the force that the lock lever receives via the retaining member from the ink ribbon by the tension of which the take-up spindle is raised acts from the center of rotation of the take-up spindle towards the center of rotation of the lock lever. It, therefore, is unnecessary to increase the spring force to be exerted to the lock lever towards locking. Therefore, the force required to lock and unlock the lock lever when opening and closing the cover will not become unnecessarily great.

The recording apparatus of the invention, as heretofore explained, is provided with a retaining member which is displaceable between a first position for holding between the take-up spindle support section and the retaining member to restrict the displacement of the take-up spindle and a second position for permitting advance of the take-up spindle to the take-up spindle support section. The take-up spindle, therefore, will not rise if a tension enough to prevent occurrence of ink ribbon crease is applied, and consequently the deterioration of printing quality by the occurrence of ink ribbon creases is effectively prevented.

In addition, the rise of the take-up spindle is effectively restricted simply by providing a retaining member for restraining the displacement of the other end in the axial direction of the take-up spindle. That is, because the take-up spindle is prevented to some extent from rising at one end in the axial direction by gear engagement for transmitting the rotation to the take-up spindle, restricting the displacement of the other end in the axial direction suffices.

Furthermore, as the take-up spindle is made by fitting a spindle in either end of the spool, the spindle is removed from the spool when a used ink ribbon is replaced, and therefore it is unnecessary to replace the spindle. Thus, the recording apparatus is economical.

Also, because the retaining member is attached on the lock lever, it is unnecessary to particularly set a support mechanism for supporting the retaining member and a positioning mechanism for positioning the support mechanism, thus effectively restraining manufacturing costs and an increase in size. That is, the lock lever is preset accurately to reliably lock the cover, and therefore the positional accuracy of the retaining member can be obtained by accurately attaching the retaining member to the lock lever.

Further, the lock lever is attached to the cover. Therefore when the cover is open during the replacement of the ink ribbon cartridge, the retaining member is positioned apart from the take-up spindle. The retaining member, therefore, will not disturb the replacement of the ribbon cartridge. Moreover, because an opposite surface of the retaining member in relation to the take-up spindle intersects at right angles a line segment connecting the center of rotation of the lock lever with the center of rotation of the take-up spindle, the lock lever can be effectively restrained from turning in the unlocking direction with the ink ribbon tension which raises the take-up spindle.

BRIEF DESCRIPTION OF THE DRAWINGS

Preferred embodiments of the invention will be described in detail with reference to the following figures, wherein.

DETAILED DESCRIPTION OF PREFERRED EMBODIMENTS

Hereinafter preferred embodiments of a recording apparatus according to the invention will be particularly explained with reference to the accompanying drawings.

Figure 1:
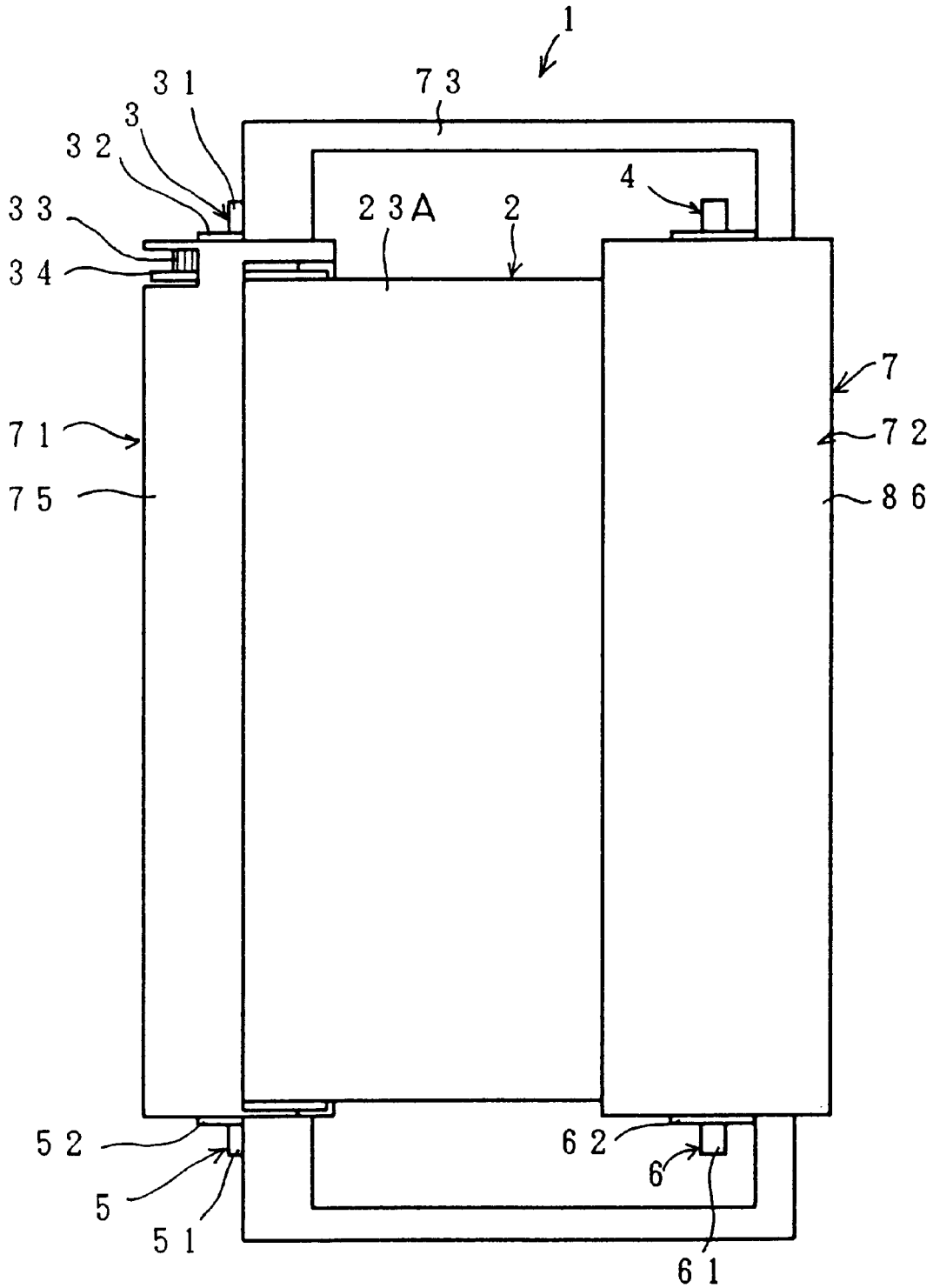
FIG. 1 is a plan view of an ink ribbon cartridge used in a recording apparatus of the invention.
Figure 2:
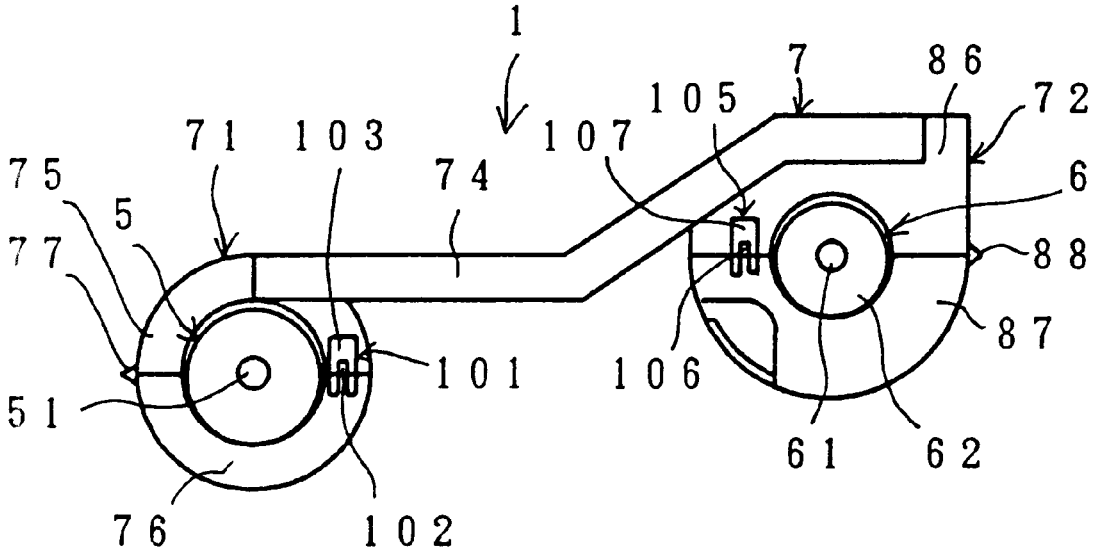
FIG. 2 is an end view of the ink ribbon cartridge shown in FIG. 1.
Figure 3:
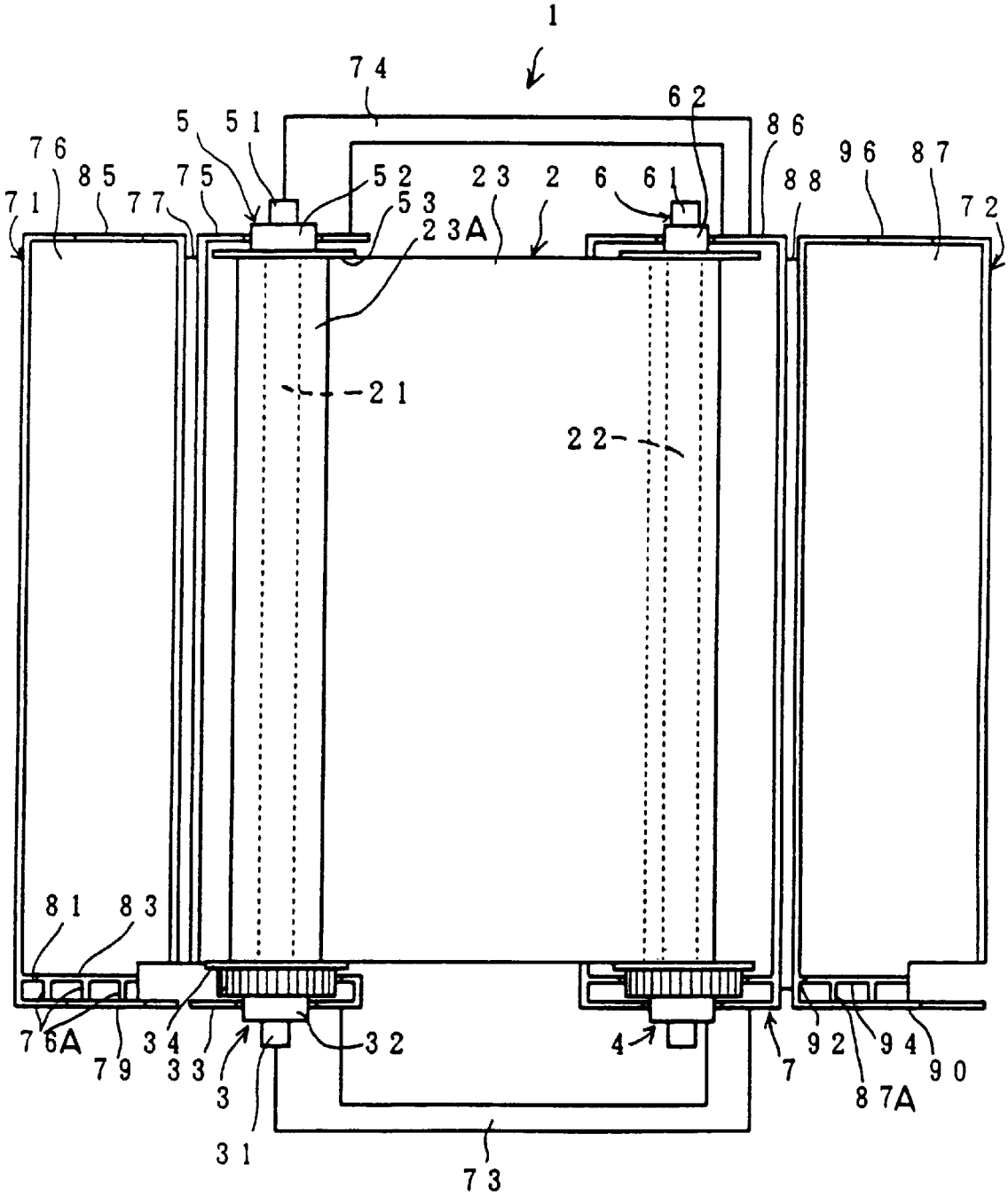
FIG. 3 is a bottom view of the ink ribbon cartridge shown in FIG. 1 in an opened state.

First, an ink ribbon cartridge to be used in the recording apparatus of the invention will be explained. FIG. 1 is a plan view of the ink ribbon cartridge according to the invention; FIG. 2 is an end view; and FIG. 3 is a bottom view thereof. In FIG. 3, the cover is in an opened state. The ink ribbon cartridge 1 is made up of an ink ribbon 2, four spindles 3 to 6, and a cover 7.

Figure 4:
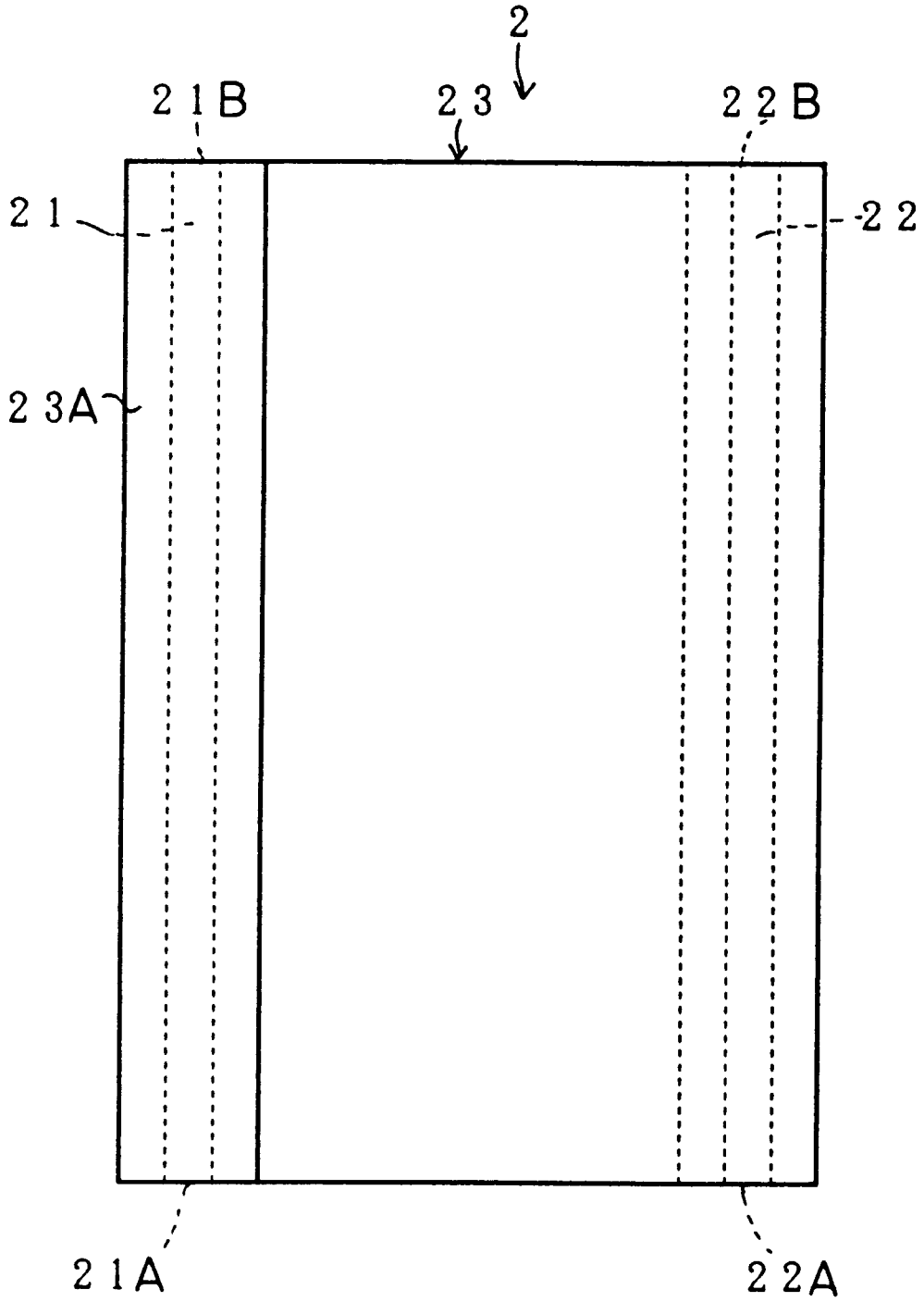
FIG. 4 is a bottom view of an ink ribbon mounted in the ink ribbon cartridge shown in FIG. 1.
Figure 5:
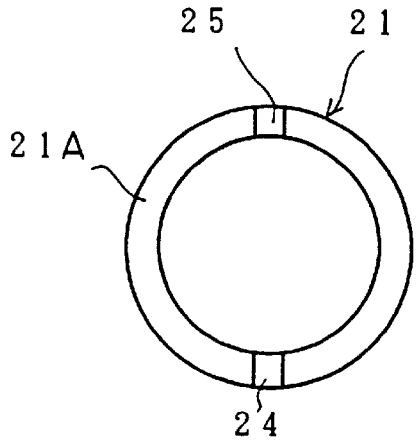
FIG. 5 is an end view of a spool mounted in the ink ribbon cartridge shown in FIG. 1.
Figure 6:
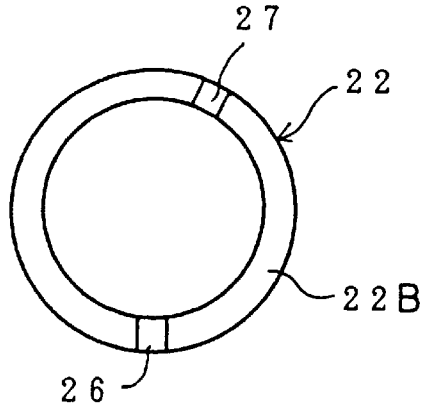
FIG. 6 is an end view of another spool mounted in the ink ribbon cartridge shown in FIG. 1.

The ink ribbon 2, as shown in FIG. 4, comprises a pair of paper spools 21 and 22, and a band-like sheet 23 wound on the spools 21 and 22. The spool 21 and the spool 22 are of the same shape and size and are cylindrical in shape. The sheet 23 has a ink layer 23A formed on the entire surface of one side of, for instance, a resin film. With the sheet 23 inserted between the recording surface of a thermal print head of a thermal printer which is a line printer and the recording paper, the current is supplied to the heating element of the thermal print head in accordance with an image data, thereby forming an image line after line on the recording paper. At this time, the recording paper opposes the ink layer 23A side. On one end face 21A of the spool 21, as shown in FIG. 5, slots 24, 25 of specific depth are formed in a radial direction. The slots 24, 25 are arranged at an interval of 180 degrees around the center of the axis of the spool 21. There are also formed slots similar to the slots 24, 25 in the other end face 21B of the spool 21 and in one end face 22A of the spool 22. In the other end face 22*b* of the spool 22, as shown in FIG. 6, slots 26, 27 of specific depth are formed in the radial direction. These slots 26, 27 are arranged at an interval of 150 degrees around the center of the axis of the spool 22.

Figure 7:
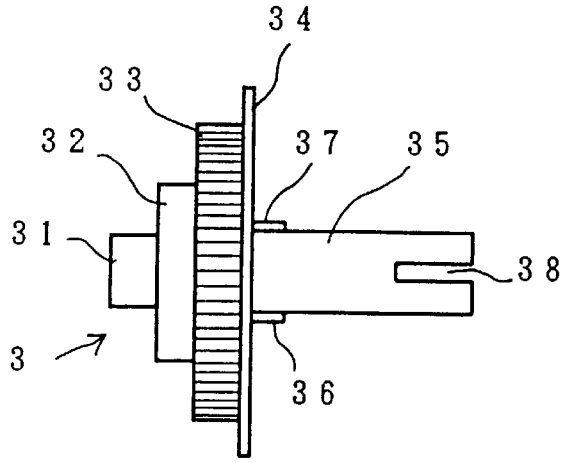
FIG. 7 is a side view of a spindle mounted in the ink ribbon cartridge shown in FIG. 1.
Figure 8:
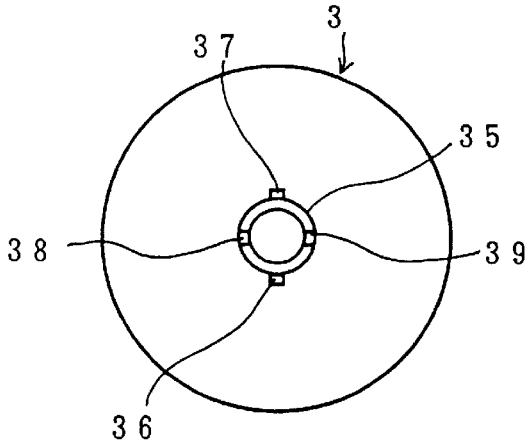
FIG. 8 is an end view of the spindle shown in FIG. 7.

The spindle 3 is unitarily molded of, for instance, a resin, and, as shown in FIGS. 7 and 8, consists of a small-diameter portion 31, a disk-shaped section 32, a gear section 33, a disk-shaped collar section 34, and a spindle portion 35, which are arranged in order of mention from one end side to the other end side. The disk-shaped section 32 has a larger diameter than the small-diameter portion 31 and the spindle portion 35; the gear section 33 has a larger diameter than the disk-shaped section 32; and the collar section 34 has a larger diameter than the gear section 33. On the outer peripheral surface of one end of the spindle portion 35 are provided projections 36, 37, which are arranged 180 degrees apart from each other around the center of the axis of the spindle portion 35. The projections 36, 37 fit in the slots 24, 25 in one end face 21A of the spool 21 when the spindle portion 35 of the spindle 3 is fitted in one end of the spool 21. In the other end of the spindle portion 35 are formed slots 38, 39 (FIG. 8). The spindle 4 is also of the same structure, and the spindle 3 and the spindle 4 are of the same shape and size.

Figure 9:
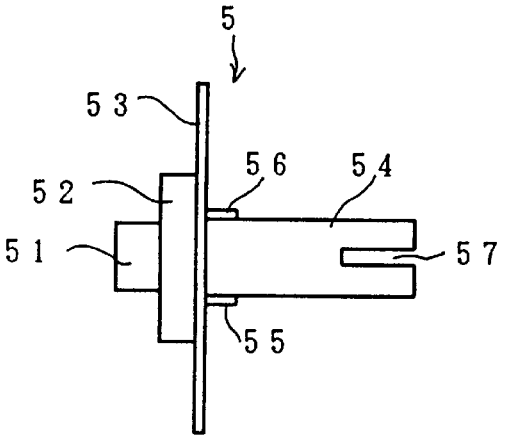
FIG. 9 is a side view of another spindle mounted in the ink ribbon cartridge shown in FIG. 1.
Figure 10:
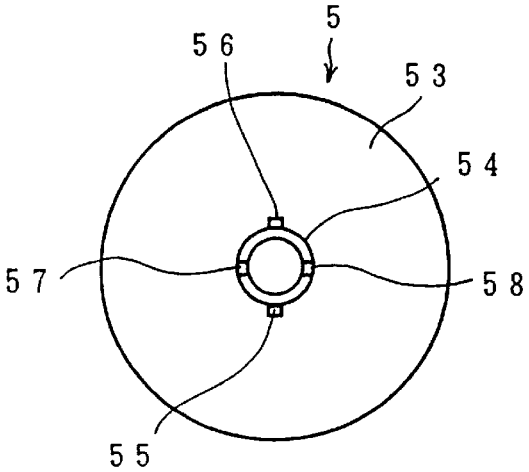
FIG. 10 is an end view of the spindle shown in FIG. 9.

The spindle 5 is unitarily molded of, for instance, a resin and, as shown in FIGS. 9 and 10, comprises a small-diameter portion 51, a disk-shaped section 52, a disk-shaped collar section 53, and spindle portion 54, which are arranged in order as mentioned from one end side to the other end side. The disk-shaped section 52 is larger in diameter than the small-diameter portion 51 and the spindle portion 54, and the collar section 53 is larger in diameter than the disk-shaped section 52. On the outer peripheral surface of one end portion of the spindle portion 54 are provided projections 55, 56, which are arranged 180 degrees apart from each other around the center of the axis of the spindle portion 54. The projections 55, 56 fit in slots in the other end face 21B of the spool 21 when the spindle portion 54 of the spindle 5 is fitted in the other end of the spool 21. In the other end of the spindle portion 54 are formed slots 57, 58. The spindle 5 is of the same shape and size as the spindle 3 with the exception that the disk-shaped section 32 and the collar section 34 are connected because the gear section 33 is removed.

Figure 11:
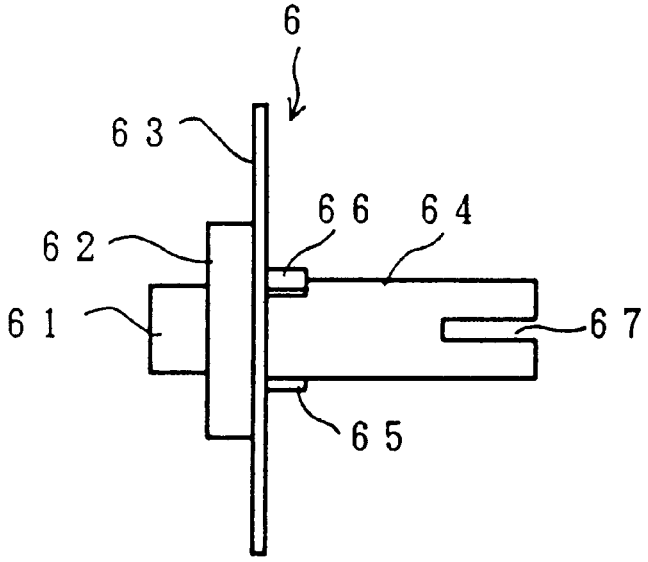
FIG. 11 is a side view of another spindle mounted in the ink ribbon cartridge shown in FIG. 1.
Figure 12:
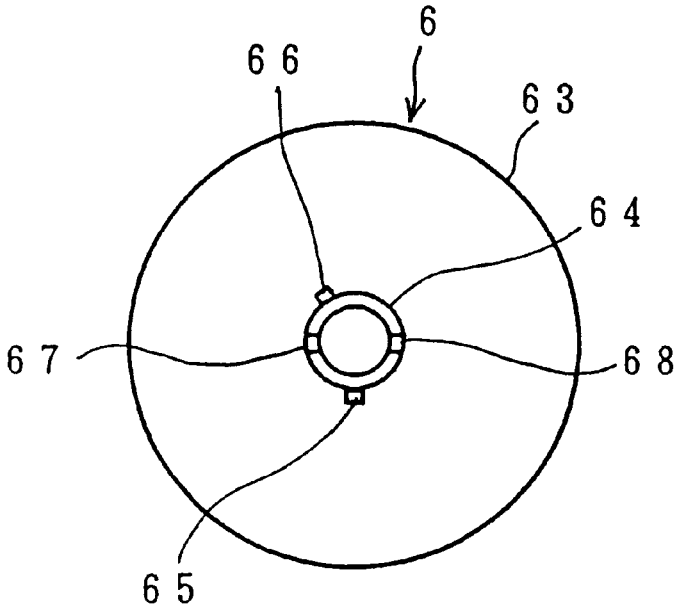
FIG. 12 is an end view of the spindle shown in FIG. 11.

The spindle 6, as shown in FIGS. 11 and 12, is unitarily molded of, for instance, a resin, and comprises a small-diameter portion 61, a disk-shaped section 62, a disk-shaped collar section 63, and a spindle portion 64, which are arranged in the order of mention from one end side towards the other end side. The disk-shaped section 62 has a larger diameter than the small-diameter portion 61 and the spindle portion 64, and the collar section 63 has a larger diameter than the disk-shaped section 62. On the outer peripheral surface of one end of the spindle portion 64 are protrusively provided projections 65, 66, which are arranged 150 degrees apart from each other around the center of the axis of the spindle portion 64. The projections 65, 66 fit in the slots 26, 27 of the other end face 22*b* of the spool 22 (FIG. 6) when the spindle portion 64 of the spindle 6 is fitted in the other end of the spindle 22. In the other end of the spool portion 64 are formed slots 67, 68. The disk-shaped section 62 of the spindle 6 is a little smaller than the disk-shaped section 52 of the spindle 5 and the spindle portion 64 is of the same shape and size as the spindle portion 54 with the projection 66 disposed 30 degrees closer to the projection 65 than is projection 56 to projection 55 of the spindle portion 54.

Figure 13:
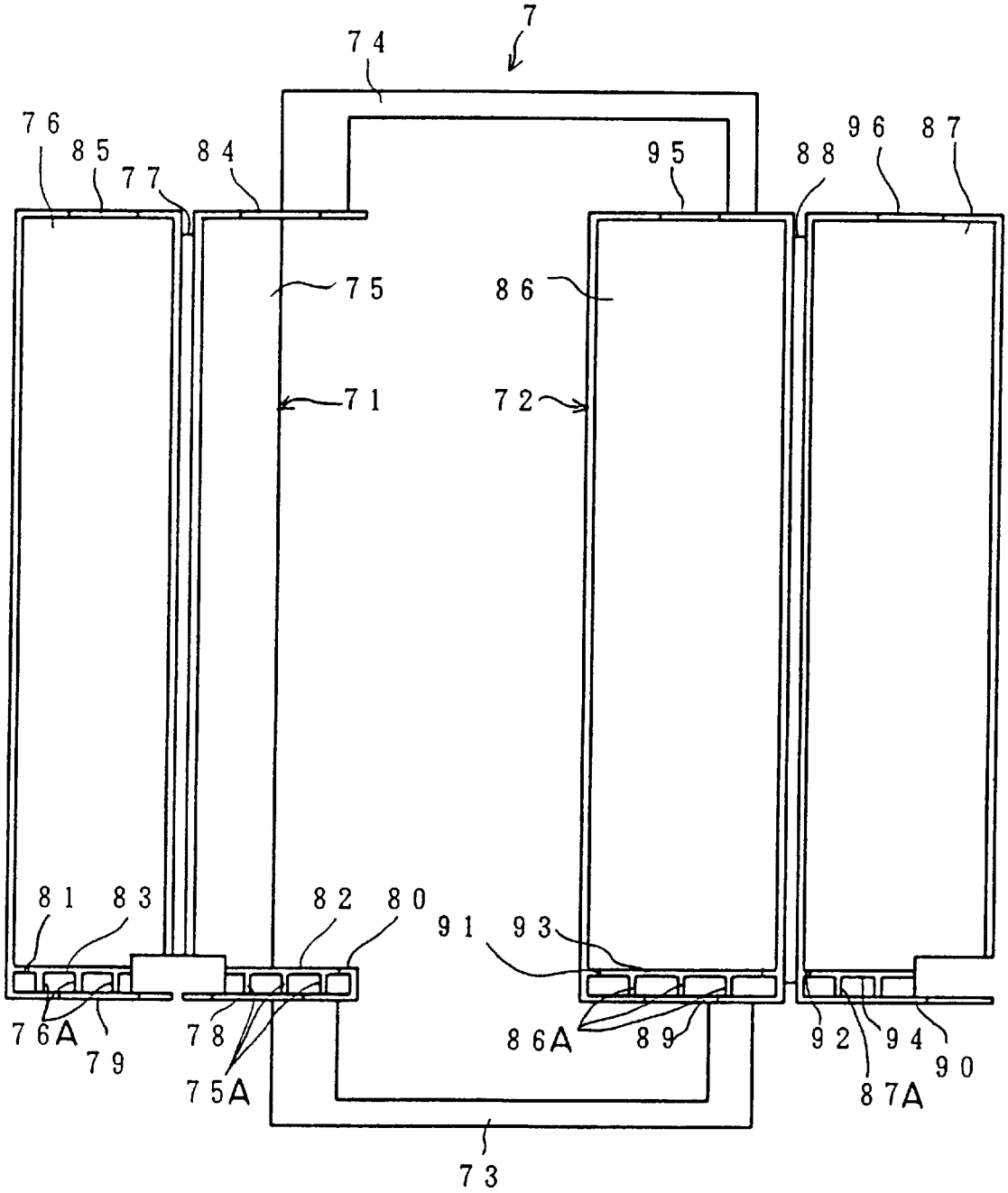
FIG. 13 is a bottom view of a cover in an opened state mounted in the ink ribbon cartridge shown in FIG. 1.

The cover 7 is unitarily molded of, for instance, a resin, and comprises, as shown in FIG. 13, a first cylindrical section 71, a second cylindrical section 72, and connecting sections 73, 74. The first cylindrical section 71 and the second cylindrical section 72 are connected by the connecting sections 73, 74. The first cylindrical section 71 consists of an upper half section 75, a lower half section 76, and a connecting section 77; the lower half section 76 is rotatable on the center of the connecting section 77. In one end wall of the upper half section 75 and the lower half section 76 are formed semi-circular recesses 78, 79. A round hole is formed by the recesses 78, 79 when the lower half section 76 is closed. The round hole formed by the recesses 78, 79 is larger in diameter than the disk-shaped section 32 of the spindle 3 and smaller in diameter than the gear section 33. In the vicinity of one end of the upper half section 75 and the lower half section 76 are formed partition walls 80, 81. In the partition walls 80, 81 are formed semi-circular recesses 82, 83. In the state that the lower half section 76 is closed, a round hole is formed by the recesses 82, 83. The round hole has a larger diameter than the gear section 33 of the spindle 3 and has a smaller diameter than the collar section 34. Between the one end wall of the upper half section 75 and the lower half section 76 and the partition walls 80, 81, a plurality of ribs 75A, 76A are protrusively provided on the inner peripheral surface of the upper half section 75 and the lower half section 76. The projecting ends of the ribs 75A, 76A are flush with the end wall of the recesses 82, 83 formed in the partition walls 80, 81. A space between the one end wall of the upper half section 75 and the lower half section 76 and the partition walls 80, 81 is nearly equal to the width of the gear section 33, and the gear cover section covering the gear section 33 comprises the one end wall of the upper half section 75 and the lower half section 76, the partition walls 80, 81, and the ribs 75A, 76A.

In the other end wall of the upper half section 75 and the lower half section 76 are formed semi-circular recesses 84, 85; when the lower half section 76 is in a closed state, a round hole is formed by the recesses 84, 85. The round hole made by the recesses 84, 85 is larger in diameter than the disk-shaped section 52 of the spindle 5 and smaller in diameter than the collar section 53.

The second cylindrical section 72 consists of an upper half section 86, a lower half section 87, and a connecting section 88. The lower half section 87 is rotatable on the center of the connecting section 88. In one end wall of the upper half section 86 and the lower half section 87 are formed semi-circular recesses 89, 90. When the lower half section 87 is in a closed state, a round hole is formed by the recesses 89, 90. The round hole formed by the recesses 89, 90 has a larger diameter than the disk-shaped section of the spindle 4 and a smaller diameter than the gear section. In the vicinity of one end of the upper half section 86 and the lower half section 87 are formed partition walls 91, 92. In these partition walls 91, 92 are formed semi-circular recesses 93, 94. When the lower half section 87 is in a closed state, the round hole is formed by the recesses 93, 94. The round hole is larger in diameter than the gear section of the spindle 4 and smaller than the collar section. Between the one end wall of the upper half section 86 and the lower half section 87 and the partition walls 91, 92, a plurality of ribs 86A, 87A are protrusively provided on the inner peripheral surface of the upper half section 86 and the lower half section 87. The protruding ends of the ribs 86A, 87A are flush with the end walls of the recesses 93, 94 formed in the partition walls 91, 92. A space between the one end wall of the upper half section 86 and the lower half section 87 is nearly equal to the width of the gear section of the spindle 4, and the gear cover section covering the gear section of the spindle 4 is formed of the one end walls of the upper half section 86 and the lower half section 87, the partition walls 91, 92, and the ribs 86A, 87A.

In the other end walls of the upper half section 86 and the lower half section 87 are formed semi-circular recesses 95, 96. When the lower half section 87 is in a closed state, a round hole is formed by the recesses 95, 96. The round hole formed by the recesses 95, 96 measures larger in diameter than the disk-shaped section 62 of the spindle 6, and smaller in diameter than the collar section 63, and further is smaller than the round hole formed by the recesses 78, 79, than the round hole formed by the recesses 84, 85, and than the round hole formed by the recesses 89, 90.

On the other end (FIG. 2) of the first cylindrical section 71 is provided a locking member 101 for releasably locking the lower half section 76 with the upper half section 75. The locking member 101 comprises a projection 102 protrusively provided on the other end face of the upper half section 75 and a locking section 103 protrusively provided on the other end face of the lower half section 76. The locking section 103 is secured at the lower end to the other end face of the lower half section 76, and the upper portion above it is bendable to this side of the paper in FIG. 2. When the projection 102 fits in the hole formed nearly at center, the projection 102 engages with the locking section 103, thus locking the lower half section 76 to the upper half section 75. On the one end face of the first cylindrical section 71 also there is provided a locking member similar to the locking member 101, that is, a locking member 101 is at both ends.

Also shown in FIG. 2, provided on the other end of the second cylindrical section 72 is a locking member 105 for releasably locking the lower half section 87 to the upper half section 86. The locking member 105 consists of a projection 106 protrusively provided on the other end face of the upper half section 86, and a locking member 107 protrusively provided on the other end face of the lower half section 87. The locking section 107 is secured at the lower end to the other end face of the lower half section 87, and the upper portion above it is bendable to this side of the paper in FIG. 2. When the projection 106 fits in the hole formed nearly at the center, the projection 106 is engaged with the locking section 107, thus locking the lower half section 87 to the upper half section 86. On the one, or opposite, end face of the second cylindrical section 72 there is also a locking member similar to the locking member 105.

The ink ribbon cartridge mounted with the spools 21, 22 of the ink ribbon 2 and with the spindles 3 to 6 inserted in the spools is as shown in FIG. 3 when mounted to the cover 7. That is, the axial movement of the spool 21 is restricted by contact between the collar section 34 of the spindle 3 and the partition walls 80, 81 of the upper half section 75 and the lower half section 76 of the first cylindrical section 71, and also by contact between the collar section 53 of the spindle 5 and the other end walls of the upper half section 75 and the lower half section 76 of the first cylindrical section 71. The axial movement of the spool 22 is restricted by contact between the collar section of the spindle 4 and the partition walls 91, 92 of the upper half section 86 and the lower half section 87 of the second cylindrical section 72. The spool 22 and the spindles 4, 6 make up a take-up spindle for taking up the sheet 23, and the spool 21 and the spindles 3, 5 make up a feed spindle for feeding the sheet 23.

To replace a used ink ribbon 2, first the cover 7 is opened as shown in FIG. 3, the used ink ribbon 2 is taken out, the spindles 3 to 6 are removed from the spools 21 and 22 of the ink ribbon 2, and then the spindles 3 to 6 are installed to the spools 21, 22 of the replacement ink ribbon 2. That is, the spindle portion 35 of the spindle 3 is fitted in one end of the spool 21, the spindle portion 54 of the spindle 5 is fitted in the other end of the spool 21, the spindle portion of the spindle 4 is fitted in one end of the spool 22, and the spindle portion 64 of the spindle 6 is fitted in the other end of the spool 22. At this time, as shown in FIG. 12, the projections 65 and 66 of the spindle 6 are 150 degrees apart from each other around the axis of the spindle portion 64. Also, as shown in FIG. 6, since the slots 26 and 27 in the other end face 22*b* of the spool 22 are arranged 150 degrees apart from each other around the center of the axis of the spool 22, the spindle portion 64 of the spindle 6 can be fitted only in the other end of the spool 22. That is, when the spindle portion 64 of the spindle 6 is fitted in one end or the other end of the spool 21 or in one end of the spool 22, the projection 65 comes into contact with the end face of the spool 21 or the spool 22 and can not be inserted any further. Further, when the spindle sections 35, 54 of the spindles 3 to 5 are fitted in the other end of the spool 22, the projections 36, 55 or the projections 37, 56 contact the end face of the spool 22, and thereafter can not be inserted any further. Consequently, the inserting position of the spindle 6 will be determined unequivocally. It is possible to identify the spindle 6 from among the four spindles 3 to 6 according to the angle of the projections 65, 66, but this identification can be done as well by using a different color for the spindle 6 from other spindles 3 to 5.

Also when the ink ribbon 2 is mounted in the cover 7, the spindle 6 will be set on the other end side of the second cylindrical section 72 because the round hole in the other end wall of the second cylindrical section 72 is smaller than the round hole in either end wall of the first cylindrical section 71 and the round hole in one end wall of the second cylindrical section 72 and therefore only the disk-shaped section 62 of the spindle 6 can be loosely fitted in the round hole. That is, when the spindles 3 to 5 are positioned on the other end side of the second cylindrical section 72, the round hole formed by the recesses 95, 96 of the upper half section 86 and the lower half section 87 of the second cylindrical section 72 is smaller in diameter than the disk-shaped section 32 of the spindle 3 and the disk-shaped section 52 of the spindle 5, the lower half section 87 can not be engaged with the upper half section 86, and accordingly the cover 7 can not be closed. Consequently, with the ink ribbon 2 set in the cover 7, the other end of the spool 22 is positioned on the other end side of the second cylindrical section 72, and accordingly the ink ribbon 2 can be set in proper mounting and winding directions.

The spindles 3 to 5 can be fitted in both ends of the spool 21 and in one end of the spool 22. If, however, the spindles 3 and 4 are inserted, for example, in both ends of the spool 21, the spool 21 becomes longer by the same amount as the width of the gear section 33 than the spool in both ends of which the spindles 3 and 5 are fitted; therefore the lower half section 76 of the first cylindrical section 71 can not be engaged with the upper half section 75. That is, let us suppose that when the disk-shaped section of the spindle 4 is fitted in the recess 84 in the other end wall of the upper half section 75 of the first cylindrical section 71, the collar section 34 of the spindle 3 is positioned between one end wall of the upper half section 75 and the partition wall 80. In this position the ribs 75A are provided and the ribs 76A are provided on the lower half section 76 side; therefore when the lower half section 76 is engaged with the upper half section 75, the inside diameter of the gear cover section comprising the one end wall of the upper half section 75 of the first cylindrical section 71, the partition wall 80, the ribs 75A and the ribs 76A are smaller than the diameter of the collar section 34 of the spindle 3. Therefore when the collar section 34 of the spindle 3 is disposed between the one end wall of the upper half section 75 and the partition wall 80, the cover 7 can not be closed.

Also, let us suppose that when the collar section 34 of the spindle 3 is held in contact with the partition wall 80 of the upper half section 75 of the first cylindrical section 71, the gear section of the spindle 4 is positioned in the recess 84 in the other end wall of the upper half section 75 of the first cylindrical section 71, and the round hole formed by the recess 84 of the upper half section 75 and the recess 85 of the lower half section 76 is smaller in diameter than the gear section of the spindle 4 and therefore the lower half section 76 of the first cylindrical section 71 can not be engaged with the upper half section 75, and therefore the cover 7 can not be closed.

Furthermore, for instance when the spindle 5 is fitted in one end of the spool 21 and then the spindle 3 in the other end of the spool 21, the collar section 53 of the spindle 5 will be positioned in the gear cover section on one end of the first cylindrical section 71. Consequently it becomes impossible to engage the lower half section 76 of the first cylindrical section 71 with the upper half section 75 as in the case the spindles 3, 4 are fitted in the both ends of the spool 21, and accordingly the cover 7 can not be closed.

Next, the recording apparatus of the invention using the above-described ink ribbon cartridge will be explained.

Figure 14:
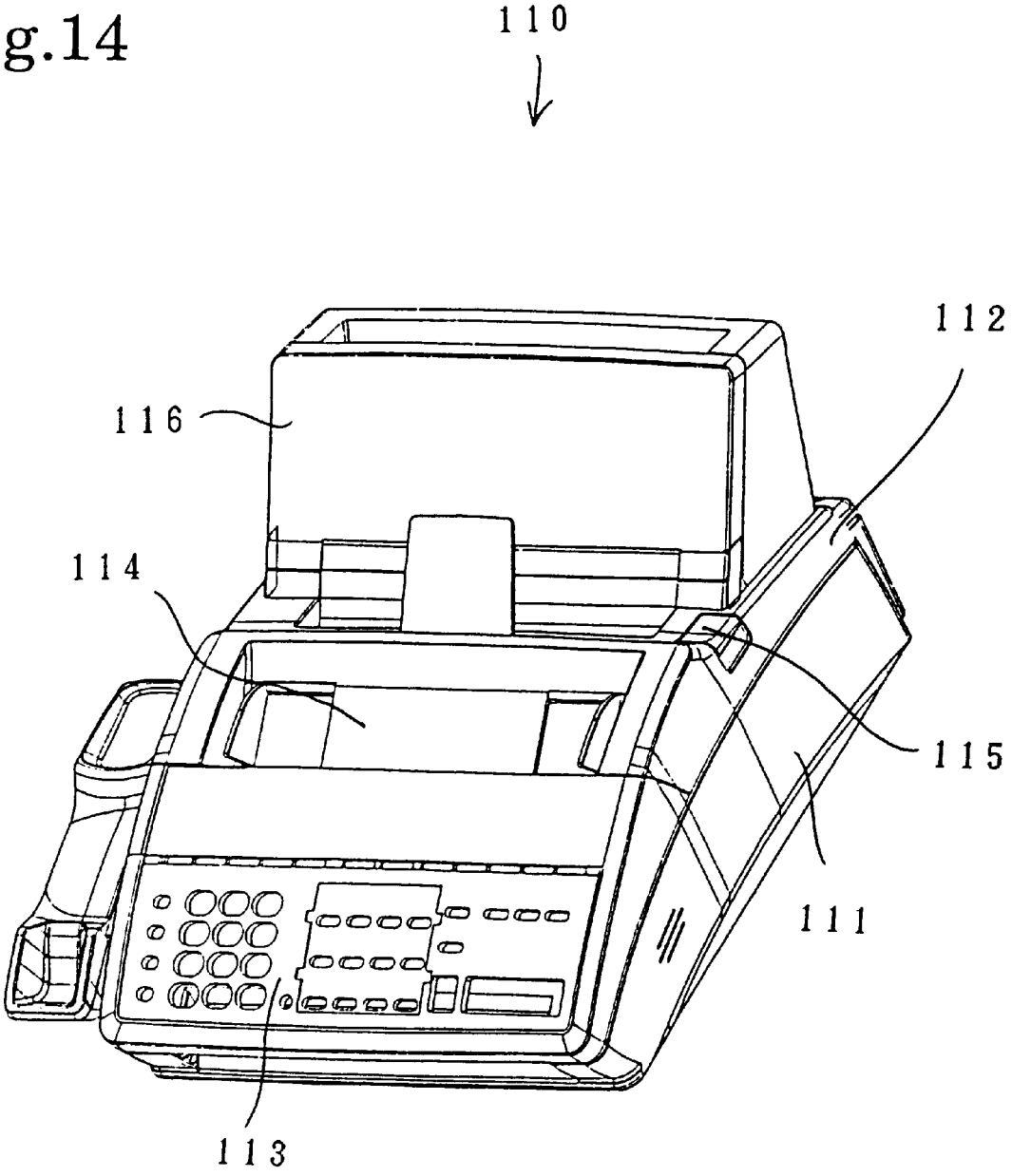
FIG. 14 is a perspective view of the outside appearance of a facsimile machine provided with a recording apparatus of the invention.

FIG. 14 is a perspective view showing the outside appearance of a facsimile machine equipped with the recording apparatus of the invention, in which the facsimile machine 110 has a casing body 111 and a cover 112 rotatably attached to the casing body 111. In the casing body 111 are mounted a control unit 113 having a plurality of key switches and a liquid-crystal display unit, and a document table 114 for mounting documents to be sent or for receiving documents. On the cover 112 are fitted an unlocking button 115 for unlocking the cover 112 from the casing body 111, and a recording paper holding section 116 for holding the recording paper.

Figure 15:
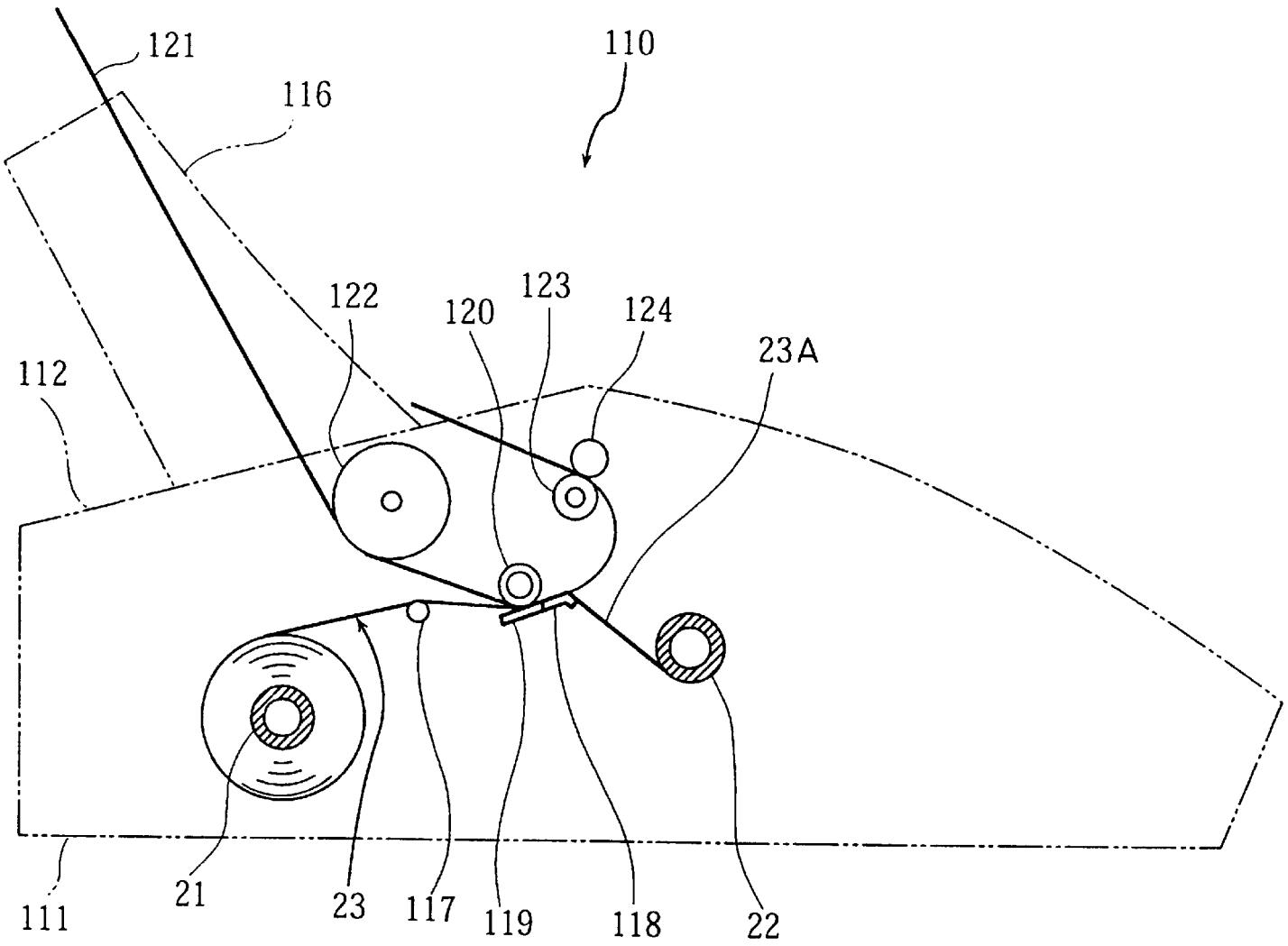
FIG. 15 is a schematic sectional view of the facsimile machine shown in FIG. 14.

FIG. 15 is a schematic sectional view of the facsimile machine 110 cut along the direction of depth at a midpoint of the direction of width of the facsimile machine 110. The sheet 23, of the ink ribbon 2, fed between the spool 22 on the take-up side and the spool 21 on the feed side is guided between a guide spindle 117 and a guide body 118, being pinched in between a recording head 119 and a press roller 120. The recording paper 121 in the recording paper holding section 116 is guided by a take-up roller 122 and a discharge rollers 123, 124 and pinched in between the recording head 119 and the press roller 120. Between the recording head 119 and the press roller 120 the ink layer 23A of the sheet 23 is in contact with the print surface of the recording paper 121.

Figure 16:
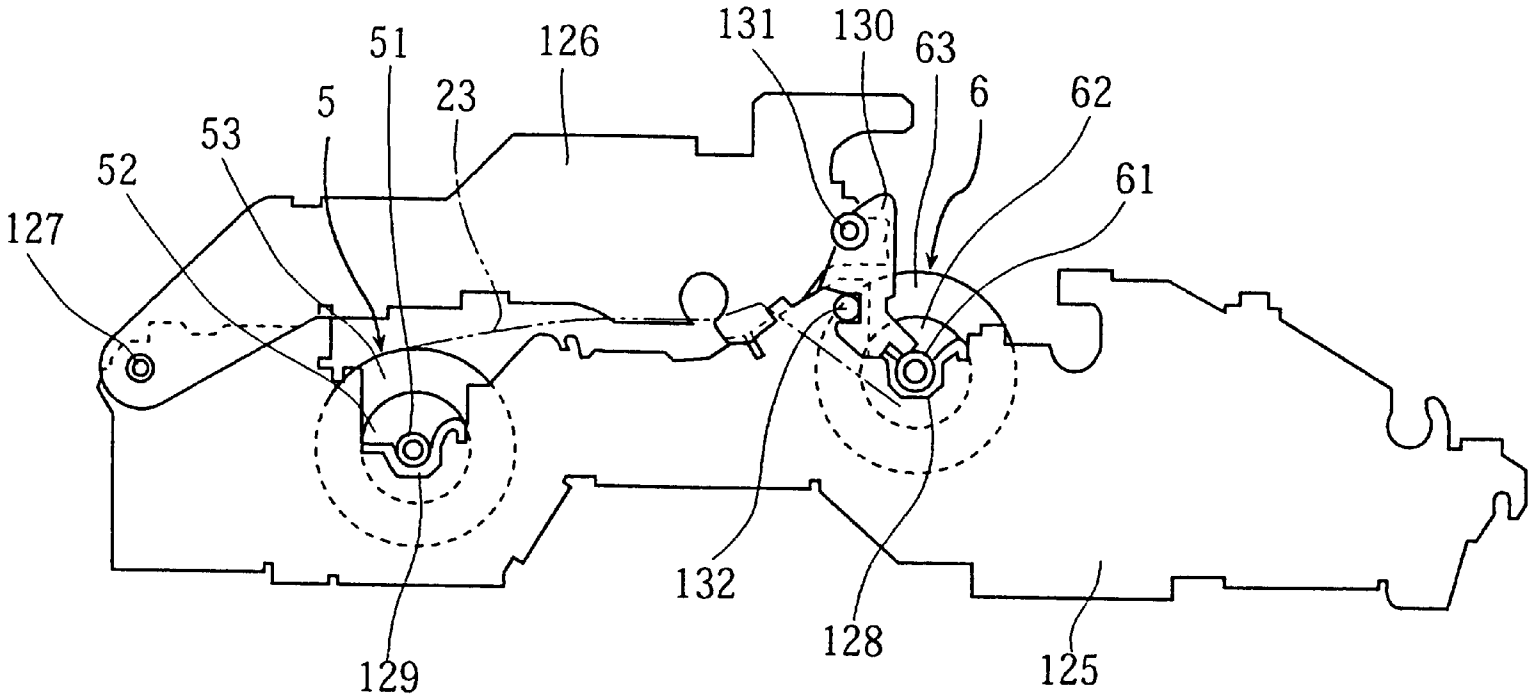
FIG. 16 is a side view of a frame of the facsimile machine shown in FIG. 14.

FIG. 16 is a side view of a frame built in the facsimile machine 110. On one end of a lower frame 125, secured in the interior of the casing body 111, an upper frame 126 is rotatably connected by a pin 127. The cover 112 is secured on the upper frame 126. The lower frame 125 and the upper frame 126 are arranged in the vicinity of the left side wall when viewed from the front of the facsimile machine 110, that is, from the control unit 113 side. A lower frame and an upper frame of a similar type are also arranged in the vicinity of the right side wall. The lower frame located in the vicinity of the right side wall is hereinafter called, when necessary, the "right lower frame", while the upper frame located in the vicinity of the right side wall is hereinafter called, when necessary, the "right upper frame." The lower frame 125 is fitted with an approximately U-shaped take-up spindle support section 128 for supporting the small-diameter portion 61 of the spindle 6 of the ink ribbon cartridge 1, and an approximately U-shaped feed spindle support 129 for supporting the small-diameter portion 51 of the spindle 5 of the ink ribbon cartridge 1. The right lower frame is also fitted with a take-up spindle support section and a feed spindle support similar to the take-up spindle support section 128 and the feed spindle support 129. The take-up spindle support section supports the small-diameter portion of the spindle 4 of the ink ribbon cartridge 1, while the feed spindle support supports the small-diameter portion 31 of the spindle 3 of the ink ribbon cartridge 1.

Figure 17:
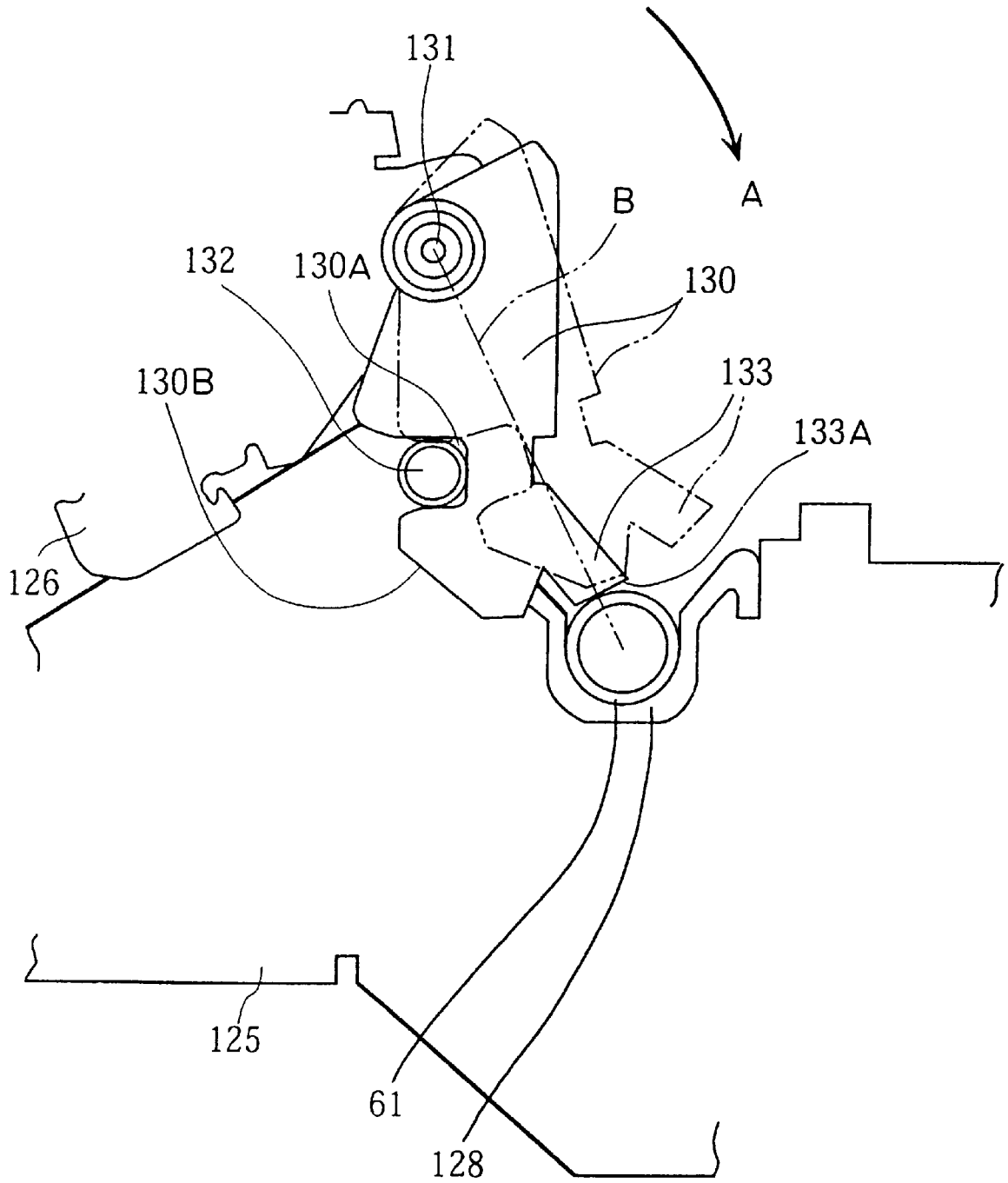
FIG. 17 is an enlarged side view of a major portion of the frame of the facsimile machine shown in FIG. 14.

A lock lever 130 is rotatably connected to the other end of the upper frame 126 by a pin 131, as shown in detail in FIG. 17. The lock lever 130 is pressed by a spring (not shown) in the direction of the arrow A in FIG. 17. A lock pin 132, secured on the lower frame 125, fits in an engaging recess 130A of the lock lever 130, thereby preventing rotation of the upper frame 126 around the pin 127. A retaining member 133 is protrusively provided as one body on the forward end of the lock lever 130 and a forward end face 133A of the retaining member 133 is in contact with the outer peripheral surface of the small-diameter portion 61. The forward end face 133A of the retaining member 133 meets at right angles the line segment B between the center of the pin 131 and the center of the small-diameter portion 61. On the right lower frame also a lock pin similar to the lock pin 132 is fitted. Furthermore on the right upper frame a lock lever is provided. This lock lever is not fitted with the retaining member 133.

If the unlocking button 115 is depressed by the user when the cover 112 is in a closed state, the lock lever 130 is turned in the opposite direction of the arrow A against the spring force by an interlock mechanism not shown, coming to a position indicated by an imaginary line in FIG. 17. Thus the lock pin 132 is disengaged from the engaging recess 130A, allowing the upper frame 126 to rotate on the center of the pin 127. Therefore, the user can open the cover 112. When the ink ribbon cartridge 1 is installed in the casing body 111 with the cover 112 opened by the user, the retaining member 133 is not present in the vicinity of the take-up spindle support section 128. The mounting operation, therefore, can easily be performed. That is, the lock lever 130 moves far away from the take-up spindle support section 128 with the rotation of the upper frame 126, allowing easy mounting of the small-diameter portion 61 of the spindle 6 on the take-up spindle support section 128.

When the user closes the cover 112, the inclined surface 130B of the forward end of the lock lever 130 contacts the lock pin 132, and accordingly after the lock lever 130 has turned in the opposite direction of the arrow A against the spring force, the lock pin 132 fits in the engaging recess 130A, then returning to the position indicated by a solid line in FIG. 17. In this position, since the small-diameter portion 61 of the spindle 6 is pinched between the take-up spindle support section 128 and the forward end face 133A of the retaining member 133, the spindle 6 will not be moved upward by the tension of the sheet 23 and accordingly the sheet 23 can be effectively prevented from creasing. There may be a small clearance between the small-diameter portion 61 of the spindle 6 and the forward end face 133A of the retaining member 133 on the condition that the sheet 23 will never crease. Because the spindle 4 is prevented to some extent from rising by the engagement of the gear section, it is possible to effectively prevent the rise of the take-up spindle simply by retaining the small-diameter portion 61 of the spindle 6 by means of the retaining member 133. That is, because the gear section of the spindle 4 is in mesh with the gear of a driving mechanism for turning the take-up spindle through the spindle 4, the spindle rise can be checked to some extent by this gear mesh. Also, as the forward end face 133A of the retaining member 133 intersects at right angles the line segment B which connects the center of the pin 131 with the center of the small-diameter portion 61 of the spindle 6, the force that the lock lever 130 receives with a force which acts to raise the spindle portion 61 of the spindle 6 is directed towards the pin 131, and the lock lever 130 will not rotate in the opposite direction of the arrow A against the spring force.

It is to be noted that, in the aforesaid embodiments, the recording apparatus of the invention is used in the facsimile machine but is not limited thereto, and the recording apparatus is usable in a printer, a copying apparatus, or an apparatus having a plurality of these functions.

What is claimed is:

1. A recording apparatus, comprising:

a replaceable ink ribbon cartridge which has an ink ribbon wound on a take-up spindle and a feed spindle;

a take-up spindle support section for rotatably supporting the take-up spindle when the ink ribbon cartridge is mounted in a specific position;

a displaceable retaining member movable between a first position for holding said take-up spindle between the take-up spindle support section and the retaining member to restrict the displacement of the take-up spindle and a second position for permitting removal of the take-up spindle from the take-up spindle support section;

a casing for housing the ink ribbon cartridge, the casing having:

a casing body in which the ink ribbon cartridge is mounted, a cover which is openably mounted to the casing body and permits replacement of the ink ribbon cartridge into the casing body when the cover is in an opened position, and a lock lever for locking the cover to the casing body when the cover is in a closed position, wherein the retaining member is mounted on the lock lever.

2. The recording apparatus according to claim 1, wherein the take-up spindle has a gear formed on one axial end;

3. The recording apparatus according to claim 2, wherein the take-up spindle comprises a spool wound with the ink ribbon and two spindles, a spindle fitted in each end of the spool, said gear is formed on one spindle of the two spindles; and the retaining member opposes the other spindle and restricts the displacement of the other spindle of the two spindles when in the first position.

4. The recording apparatus according to claim 1, wherein the lock lever is rotatably mounted at one end to said cover, and an opposite end of the lock lever mounting the retaining member adjacent to the take-up spindle to intersect at right angles a line segment connecting a center of rotation of the lock lever with a center of rotation of the take-up spindle.

5. A printing apparatus, comprising:

a replaceable ink cartridge having:

a cartridge case having a first cylindrical section and a second cylindrical section;

a first spool rotatably mounted in the first cylindrical section;

a second spool rotatably mounted in the second cylindrical section; and an ink ribbon extending between the first spool and the second spool;

a frame having a pair of side sections, each side section comprising a lower frame having a pair of spool support sections, for receiving an end of the first spool and an end of the second spool respectively, and an upper frame pivotally mounted to the lower frame; and a lock lever pivotally mounted to the upper frame of one side section for locking the upper frame to the lower frame, the lock lever mounting a retaining member at an end away from the pivotal mount to the upper frame, wherein the lock lever is pivotal between a first position for locking the upper frame to the lower frame and the retaining member retains an end of the first spool in a first support section of the pair of support sections and a second position releasing the upper frame from the lower frame and the retaining member from the first spool.

6. The printing apparatus according to claim 5, wherein each of the first spool and the second spool comprises:

a hollow tube;

a first spindle mounted to one end of the hollow tube; and a second spindle mounted to the opposite end of the hollow tube.

7. The printing apparatus according to claim 6, wherein the retaining member retains the first spindle of the first spool when in the first position.

8. The printing apparatus according to claim 6, wherein the second spindle of the first spool has a gear for imparting drive rotation to the first spool.

9. The printing apparatus according to claim 7, wherein the second spindle of the first spool has a gear for imparting drive rotation to the first spool.

10. The printing apparatus according to claim 9, wherein the retaining member engaging the first spindle and the gear when imparting drive rotation prevents the ends of the ink cartridge from rising from the support sections receiving the ends of the first spool.

11. A print cartridge for a printing device, comprising:

a case body having a first cylindrical section, a second cylindrical section, and a connecting portion connecting the first cylindrical section and the second cylindrical section;

a first spool comprising a first hollow tube, a first spindle mounted to one end of the first hollow tube and a second spindle mounted to the opposite end of the first hollow tube;

a second spool comprising a second hollow tube, a third spindle mounted to one end of the second hollow tube and a fourth spindle mounted to the other end of the second hollow tube, the first and third spindles being identical and including a peripheral gear for applying rotation to the first spool and second spool respectively when the first spool is rotatably mounted in the first cylindrical section and the second spool is rotatably mounted in the second cylindrical section, the second and fourth spindles having a spindle portion received in an end of a respective hollow tube, a disk-shaped collar section, a disk-shaped section and a small diameter section, away from the hollow tube, the disk-shaped portion of the second spindle having a greater diameter than the disk-shaped section of the fourth spindle.

12. The print cartridge as claimed in claim 11, wherein each of the first cylindrical section and the second cylindrical section comprises:

a fixed half cylindrical section;

a movable half cylindrical section;

a connecting member along one edge of each of the fixed half cylindrical section and movable cylindrical half section to connect the sections; and locking means to lock the movable cylindrical half section to the fixed cylindrical half section.

13. The print cartridge according to claim 11, wherein the first cylindrical section and the second cylindrical section have round openings in each axial end.

14. The print cartridge according to claim 13, wherein each spindle has an axially extending disk-shaped part for mounting in a corresponding axial hole in an appropriate cylindrical section, the disk-shaped section of the second spindle and the fourth spindle providing the disk-shaped part.

15. The print cartridge according to claim 14, wherein the first and third spindles have a disk-shaped section and a disk-shaped collar section abutting the end of the hollow tube, the peripheral gear between the disk-shaped section and the collar section and the first and third spindles have a small diameter section axially extending from the disk-shaped section and a spindle portion axially extending from the disk-shaped collar section.

16. The print cartridge according to claim 15, wherein each end of each hollow tube has a pair of slots therein, the slots at each end of the first hollow tube and at one end of the second hollow tube offset by 180° and the slots at the other end of the second hollow tube offset by an angle less than 180°, the first, second and third spindles have a pair of projections, offset by 180° and extending from the spindle portion adjacent to the collar section for engaging a respective pair of slots in the end of the hollow tube to which mounted and the fourth spindle has a pair of projections offset by less than 180° and extending from the spindle portion adjacent the collar section for engaging the pair of slots in the other end of the second hollow tube.

17. The print cartridge according to claim 15, wherein the disk-shaped section of the first spindle and of the third spindle provide the disk-shaped part.

* * * * *